US010400659B2

(12) United States Patent
Hoffmann et al.

(10) Patent No.: US 10,400,659 B2
(45) Date of Patent: Sep. 3, 2019

(54) COOLANT PUMP WITH INTEGRATED CLOSED-LOOP CONTROL

(71) Applicant: NIDEC GPM GmbH, Auengrund OT Merbelsrod (DE)

(72) Inventors: Jens Hoffmann, Schwarzbach (DE); Franz Pawellek, Lautertal (DE)

(73) Assignee: NIDEC GPM GMBH, Auengrund OT Merbelsrod (DE)

( * ) Notice: Subject to any disclaimer, the term of this patent is extended or adjusted under 35 U.S.C. 154(b) by 187 days.

(21) Appl. No.: 15/502,362

(22) PCT Filed: Jul. 17, 2015

(86) PCT No.: PCT/EP2015/066473
§ 371 (c)(1),
(2) Date: Feb. 7, 2017

(87) PCT Pub. No.: WO2016/012379
PCT Pub. Date: Jan. 28, 2016

(65) Prior Publication Data

US 2017/0254253 A1 Sep. 7, 2017
US 2018/0119596 A9 May 3, 2018

(30) Foreign Application Priority Data

Jul. 21, 2014 (DE) ..... 10 2014 110 231
Jun. 22, 2015 (DE) ..... 10 2015 109 966

(51) Int. Cl.
*F01P 7/14* (2006.01)
*F04D 13/12* (2006.01)
(Continued)

(52) U.S. Cl.
CPC ..... *F01P 7/14* (2013.01); *F01P 3/20* (2013.01); *F01P 5/10* (2013.01); *F04B 19/22* (2013.01);
(Continued)

(58) Field of Classification Search
CPC ..... F01P 7/14; F01P 3/20; F01P 5/10; F01P 2005/105; F01P 2007/146; F04B 19/22;
(Continued)

(56) References Cited

U.S. PATENT DOCUMENTS

2007/0215115 A1 9/2007 Hazama
2011/0188987 A1 8/2011 Schmidt et al.
(Continued)

FOREIGN PATENT DOCUMENTS

CN 202117755 U 1/2012
DE 102004012383 B3 6/2005
(Continued)

OTHER PUBLICATIONS

International Preliminary Report on Patentability dated Feb. 2, 2017 for related International Application No. PCT/EP2015/066472 (WO2016/012378), filed Jul. 17, 2015 (8 Pages).
(Continued)

*Primary Examiner* — Calvin Cheung
(74) *Attorney, Agent, or Firm* — Daniel F. Nesbitt; Hasse & Nesbitt LLC

(57) ABSTRACT

A coolant pump for an internal combustion engine (ICE) in a vehicle with a central engine control, having a pump shaft that drives an impeller for pumping a coolant. An axial piston pump operated via a wobble plate on a rear face of the impeller, conducts part of the pumped coolant away to a hydraulic circuit that extends from the axial piston pump via a proportional valve back to the pumped coolant and has a branch-off between the axial piston pump and the proportional valve as the hydraulic actuator. A regulating slide valve adjusts coolant volume flow of depending on pressure in the hydraulic circuit. A sensor detects a parameter characteristic of the coolant volume flow and outputs an actual value signal. A dedicated pump control controls the proportional valve based on the actual value signal of the sensor and a desired value signal of the central engine control.

17 Claims, 4 Drawing Sheets

(51) Int. Cl.

| | |
|---|---|
| ***F04D 15/00*** | (2006.01) |
| ***F01P 3/20*** | (2006.01) |
| ***F01P 5/10*** | (2006.01) |
| ***F04B 19/22*** | (2006.01) |
| ***F04D 1/00*** | (2006.01) |

(52) U.S. Cl.
CPC ..... *F04D 1/00* (2013.01); *F04D 13/12* (2013.01); *F04D 15/0038* (2013.01); *F01P 2005/105* (2013.01); *F01P 2007/146* (2013.01); *F05D 2270/64* (2013.01)

(58) Field of Classification Search
CPC ..... F04D 1/00; F04D 13/12; F04D 15/0038; F05D 2270/64
See application file for complete search history.

(56) References Cited

U.S. PATENT DOCUMENTS

| | | | | |
|---|---|---|---|---|
| 2012/0204818 | A1 | 8/2012 | Welte et al. | |
| 2014/0212267 | A1 | 7/2014 | Pawellek | |
| 2015/0275742 | A1* | 10/2015 | Chekaiban ..... | F01P 3/20 123/41.08 |

FOREIGN PATENT DOCUMENTS

| | | | |
|---|---|---|---|
| DE | 102006048255 | A1 | 4/2008 |
| DE | 102007042866 | A1 | 3/2009 |
| DE | 102008022354 | B4 | 1/2012 |
| DE | 102011004172 | B3 | 3/2012 |
| DE | 102011113040 | B3 | 4/2012 |
| DE | 102011079311 | A1 | 1/2013 |
| DE | 102013011209 | B3 | 1/2014 |
| JP | 2007231907 | A | 9/2007 |

OTHER PUBLICATIONS

International Preliminary Report on Patentability dated Feb. 2, 2017 for corresponding International Application No. PCT/EP2015/066473 (WO2016/012379), filed Jul. 17, 2015 (8 Pages).
PCT/EP2015/066473 Chinese Office Action dated Jun. 14, 2018 (9 pages) with English translation (12 pages). (21 pages total).
PCT/EP2015/066473 Korean Office Action dated Feb. 14, 2018 (10 pages) with English translation (7 pages). (17 pages total).

* cited by examiner

COOLANT PUMP WITH INTEGRATED CLOSED-LOOP CONTROL

The present invention relates to a coolant pump for pumping a coolant for an internal combustion engine in a vehicle comprising the internal combustion engine and a central engine control unit.

Developments have been made with a view to designing the thermal management of internal combustion engines so as to be more efficient, in order to reduce fuel consumption and emissions by vehicles. To this end, coolant pumps have been developed which facilitate a reliable and continuous adjustment of the volume flow of the circulating coolant. In order to keep the internal combustion engine in an optimum temperature range for efficient combustion and minimal exhaust emissions, the heat output of the cooling system is controlled depending on the current operating state. During a cold start phase, for example, heat output is prevented, initially altogether, and subsequently in part.

In the field of mechanically driven coolant pumps, with which a rotation of the internal combustion engine is transferred to a pump shaft via a belt drive, coolant pumps comprising an electro-hydraulically controlled regulating slide valve for adjusting the volume flow proved to be particularly reliable in the course of these developments. A pump of this design, which is now referred to as an ECF (electro-hydraulically controlled flow) pump, is disclosed for example in the German patent specification DE 10 2008 026 218 B4 of the applicant.

With such a coolant pump, a cylindrical regulating slide valve is moved by way of a hydraulic actuator around a peripheral region of an impeller of the coolant pump. In this case the hydraulic pressure of the actuator is not produced as result of a closed circuit with hydraulic oil; rather, it is applied via an auxiliary flow of the coolant. Pumps with such a coolant-based hydraulic system do not require additional dynamic seals against the atmosphere and have proved successful owing to their long service lives and the reliable control thereof.

The volume flow of the coolant to be pumped from a coolant pump is customarily controlled by a central engine control unit ZMS of a vehicle. In the case of a known coolant pump, a position of the regulating slide valve is detected for this purpose and transferred to the central engine control unit ZMS. The central engine control unit ZMS controls an electromagnetic valve in the hydraulic circuit depending on further operating parameters such as the speed of the internal combustion engine, the working load of the combustion engine, the amount of fuel supplied, the temperature and the like.

Depending on the number of parameters to be determined and the number of measuring elements necessary for this as well as the number of actuators to be controlled, a corresponding number of electric cables from the central engine control unit ZMS to the individual elements of the control circuit is required. In order to install an ECF pump, at least two cables must be installed for the power supply and for the signal communication both from the central engine control unit ZMS to the position sensor and from the central engine control unit ZMS to the electromagnetic valve.

The invention is based on the object of providing a coolant pump which requires minimal effort in terms of installation and which provides a high degree of operational reliability in a corrosive environment.

According to the invention, this object is achieved by a coolant pump with the features of claim 1.

This coolant pump is particularly characterised by the fact that it comprises its own pump control which controls a proportional valve in a hydraulic circuit on the basis of the actual value signal from the sensor and a desired value signal from the central engine control unit and in that the pump control and the proportional valve are formed as a single electromechanical component.

The invention therefore provides for the first time in the design of coolant pumps a dedicated control circuit for position controlling a regulating slide valve which includes a hydraulic actuator as an integrated component.

The coolant pump according to the invention therefore comprises fewer electric cables to the central engine control unit than a conventional system. In particular, there is no need for a separate power supply or communication interface between both the central engine control unit ZMS and the electromagnetic proportional valve and the central engine control unit ZMS and a sensor for determining a parameter (such as the position of the regulating slide valve) which is indicative of the volume flow of the pumped coolant.

Just one power supply cable and one communication cable to the central engine control unit ZMS are required in the case of the coolant pump according to the invention. The fact that fewer cables and plug connections are required simplifies the design and reduces the manufacturing cost of the coolant pump as well as the cost of installing it in the vehicle.

Moreover, the coolant pump's susceptibility to failure can also be improved, since there is no need for corrodible plug connections and/or outlet seals on the pump housing for the wiring in the region of the engine compartment of the vehicle, which is exposed to the effects of the weather and stirred up grit.

The central engine control unit does not require a programming procedure for position controlling the regulating slide valve either. As a consequence, the processing load of the central engine control unit can be reduced. Thus, either a central engine control unit with lower processing power at a corresponding lower cost can be used or the unused processing power can be made available for control functions of other peripheral devices, or to achieve an increased frequency of calculation cycles.

As a result of the integration of a control circuit of the pump control into the proportional valve as a single electromechanical component, external wiring to different regions of the pump construction can be dispensed with. The installation of the coolant pump can thereby be simplified and there is no need for corrodible plug connections and/or outlet seals on the pump housing for the wiring.

Advantageous embodiments of the coolant pump according to the invention are described in the dependent claims.

In a further embodiment of the present invention, the sensor can be a position sensor, in particular a Hall effect sensor, for detecting the position of the regulating slide valve. In this case, the desired value signal indicates a predetermined position of the regulating slide valve or a predetermined volume flow and the speed of the combustion engine or coolant pump.

If the desired value signal from the central engine control unit and the actual value signal from the position sensor each indicate a positional value of the regulating slide valve, the position control can be implemented in the pump control with a simple calculation procedure. The calculating capacity of the pump control as well as the power required and resulting waste heat in an enclosed electronic component can thereby be kept to a minimum.

If the desired value signal from the central engine control unit indicates a predetermined volume flow and a speed, a calculation procedure is performed by the pump control between the volume flow and the position of the regulating slide valve to be controlled depending on the pump speed. As a result, there is no need for a specific calculation based on individual parameters of the coolant pump by the central engine control unit. The central engine control unit then only transfers as a desired value signal a value corresponding to a volume flow, i.e. an amount of heat to be dissipated. The required heat output can be calculated by the central engine control unit on the basis of the operating parameters of the internal combustion engine. In this way, good compatibility and interchangeability between the coolant pump according to the invention and various central engine control units can be ensured.

According to one embodiment of the present invention, in the upper speed range of the pump the pump control can limit the path of the regulating slide valve. As a result, the pump control performs a protective function for components such as seals in the cooling system, in order to limit a maximum volume flow and the resulting pressure.

Moreover, according to one embodiment of the present invention, the pump control can compare the relationship between the control duration of the proportional valve and a resulting position change of the regulating slide valve with a threshold value. In this way, the pump control carries out autonomous function monitoring to ensure the cooling system has a sufficient fill quantity of coolant.

Since in this case the hydraulic circuit is used as a pressure-sensitive sensor, function monitoring can be implemented in the cooling system to ensure the timely detection of leaks without the need for further measuring elements, such as pressure gauges or other sensors, to be provided. This means that the number of components and wires as well as the costs and outlay involved in installation can be kept to a minimum.

In an alternative embodiment of the present invention, the sensor can be a pressure sensor for detecting the pressure of the pumped volume flow of the coolant. In this case, the desired value signal indicates a predetermined volume flow or a pressure which is indicative of the volume flow of the pumped coolant. The pressure sensor can preferably detect a pressure in the pump chamber which is in proportion to the pumped volume flow of the coolant pump.

According to one embodiment of the present invention, the pump control can compare the pressure detected by the sensor with a threshold value. In this way, it is possible for the pump control of the alternative embodiment to carry out with particular ease autonomous function monitoring with a pressure sensor, to ensure the cooling system has a sufficient fill quantity of coolant.

Function monitoring to ensure the timely detection of leaks can also be implemented with this embodiment without the need for further measuring elements to be provided in the cooling system, as a consequence of which the number of components and wires as well as the costs and outlay involved in installation can be kept to a minimum.

According to one embodiment of the present invention, the pump control can comprise a transceiver for receiving data from the central engine control unit and/or for sending data thereto, a microcomputer for performing a control procedure, a valve driver for controlling the proportional valve, and a power supply distributor for supplying each component with electric power. With this configuration, a control circuit of the pump control with small dimensions and advantageous installation possibilities in the coolant pump can be realised.

According to one embodiment of the present invention, the pump control can have a housing of its own which is integrated into the single electromechanical component With this design, the control circuit of the pump control can, for example, be effectively protected against electromagnetic interference from the proportional valve disposed in the electromechanical component, particularly with a magnetically actuated valve.

According to one embodiment of the present invention, the proportional valve can have a housing of its own which is integrated into the single electromechanical component 20. With this design too, the control circuit of the pump control can be effectively protected against electromagnetic interference resulting from the magnetic actuation of the proportional valve.

According to one embodiment of the present invention, the coolant to be pumped can flow through a coolant inlet such that it is directed axially at the impeller and can be pumped by the impeller so as to leave the pump chamber via a radial coolant outlet. The invention therefore makes use of the configuration of a radial pump.

According to one embodiment of the present invention, the coolant to be pumped can flow through a coolant inlet such that it is directed axially at the impeller and can be pumped by the impeller so as to leave the pump chamber via an axial or semi-axial coolant outlet on the opposite side of the impeller. The invention therefore makes use of the configuration of an axial or a semi-axial pump.

An electronic component according to the invention which is adapted for use in a mechanically driven coolant pump of a vehicle with an internal combustion engine and a central engine control unit comprises a pump control and a proportional valve configured as a hydraulic actuator of a hydraulic circuit, wherein the position of a regulating slide valve which limits the pumped volume flow of the coolant pump is shifted by the hydraulic circuit in a pump chamber. The electronics required for the control can therefore be integrated with, exchanged for or retrofitted with a component in the coolant pump.

A method according to the invention for controlling the inventive mechanically driven coolant pump of a vehicle with an internal combustion engine and a central engine control unit comprises the following steps: calculating by way of the central engine control unit the desired value of a parameter, which is indicative of the volume flow of the pumped coolant, depending on operating parameters of the internal combustion engine; transmitting the desired value from the central engine control unit to a pump control of the coolant pump; detecting the actual value of the parameter by a sensor; transmitting the actual value from the sensor to the pump control; and adjusting by way of the pump control the position of a regulating slide valve, which limits the pumped volume flow of the coolant pump, depending on the desired value and the actual value by controlling a hydraulic actuator. In this way, the invention makes use of a coolant pump of the aforementioned embodiments.

An alternative method according to the invention for controlling the inventive mechanically driven coolant pump of a vehicle with an internal combustion engine and a central engine control unit comprises the following steps: transmitting operating parameters of the internal combustion engine from the central engine control unit to a pump control of the coolant pump; calculating by way of the pump control the desired value of a parameter, which is indicative of the volume flow of the pumped coolant, depending on the operating parameters of the internal combustion engine; detecting an actual value of the parameter by a sensor; transmitting the actual value from the sensor to the pump control; and adjusting by way of the pump control the position of a regulating slide valve, which limits the pumped volume flow of the coolant pump, depending on the desired value and the actual value by controlling a hydraulic actuator. In this alternative way, the invention makes use of a coolant pump of the aforementioned embodiments.

According to one embodiment of the present invention, the parameter which is indicative of the volume flow of the pumped coolant can be the position of the regulating slide valve. This makes it possible to use the control method for the configuration described above of the coolant pump according to the invention.

According to one embodiment of the present invention, the parameter which is indicative of the volume flow of the pumped coolant can be the pressure in a pump chamber of the coolant pump which corresponds to the volume flow of the pumped coolant. This makes it possible to use the control method for an alternative embodiment of the coolant pump according to the invention.

The invention will now be explained by way of an example embodiment with reference to the Figures in which.

Figure 1:
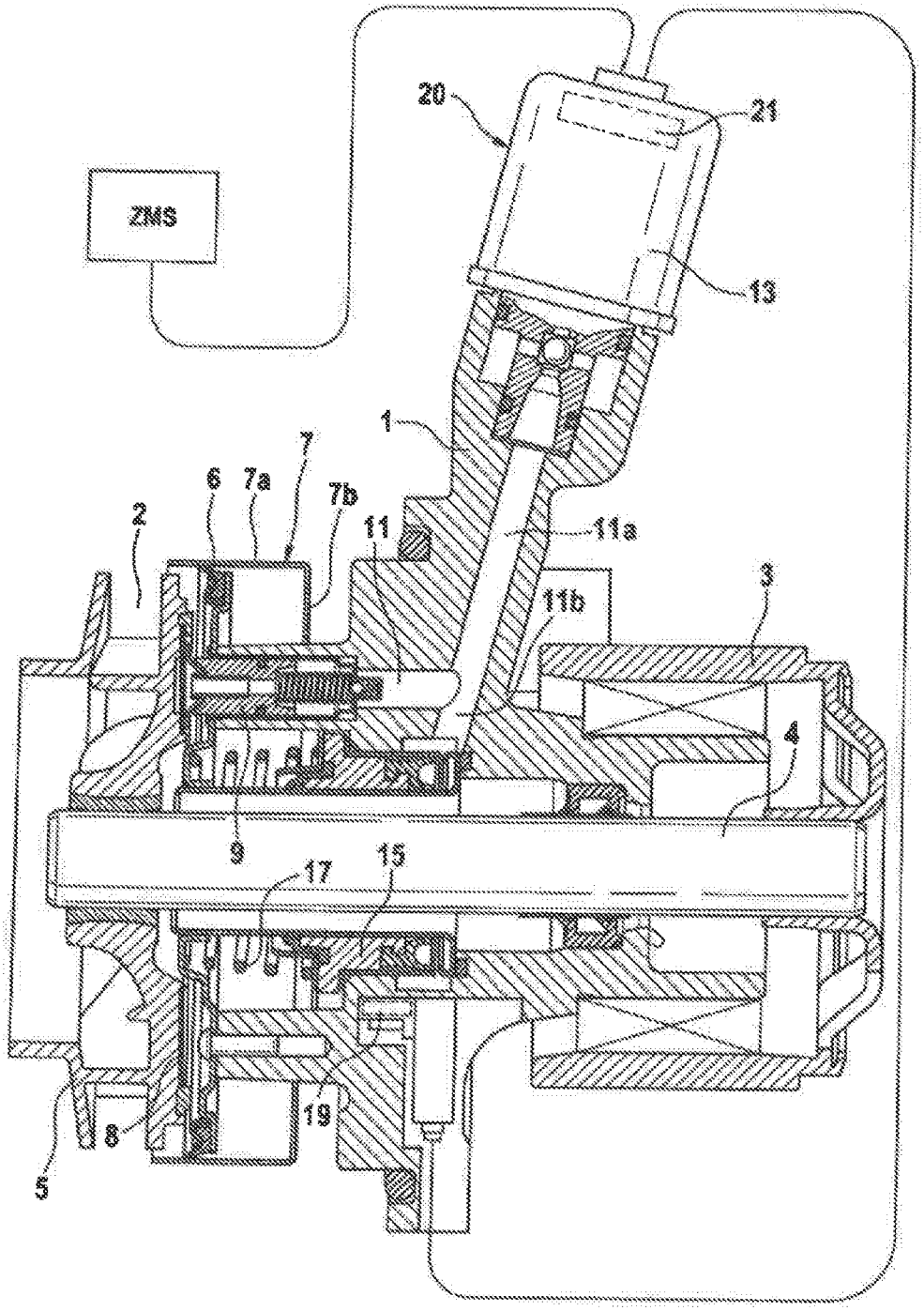
FIG. 1 is a schematic sectional view of an inner region of the coolant pump and of wiring of the pump control according to the present invention.

An exemplary configuration of the coolant pump will now be described with reference to FIGS. 1 and 2.

The coolant pump comprises a pump housing 1 and a pump shaft 4 which is rotatably mounted therein and which includes a pulley 3 driven by an internal combustion engine (not shown) through a belt drive. An impeller 5, which is disposed inside a pump chamber 2 in a flow area of a cooling circuit of the internal combustion engine to induce a volume flow of the coolant, is non-rotatably arranged at a free end of the pump shaft 4. The coolant is drawn through an axial inlet of the pump chamber 2 in the region of a central radius of the impeller 5 and is ejected, for example, through a radial outlet (not shown) of the pump chamber 2 which is opposite to a peripheral region of the impeller 5.

The flow area of the impeller 5 can be variably covered along a displacement path extending in parallel to the pump shaft 4 by way of a regulating slide valve 7 with a cylindrical portion 7*a* arranged coaxially to the pump shaft and a back wall portion 7*b*. A sealing lip 6 extends between the inner peripheral wall of the cylindrical portion 7*a* of the regulating slide valve 7 and a rear wail of the pump chamber 2. In FIGS. 1 and 2, the regulating slide valve 7 is in an "open position" in which the flow area of the impeller 5 is not covered.

The pump chamber 2 also has arranged therein an axial piston pump 9 on the back side of the impeller 5 and in parallel to the pump shaft 4, the piston of which is actuated via a sliding block which slides on a wobble plate 8 arranged on the rear side of the impeller 5 so as not to rotate therewith relative to the pump shaft 4.

The axial piston pump 9 draws coolant from the flow area in the pump chamber 2 between the impeller 5 and the regulating slide valve 7 and ejects the coolant under pressure into a hydraulic circuit 11 formed in the pump housing 1. The hydraulic circuit 11 branches out into two branches 11*a* and 11*b*. The one branch 11*a* of the hydraulic circuit 11 leads, on the one hand, to an electromagnetic proportional valve 13 and back again into the pumped coolant flow. The other branch 11*b* of the hydraulic circuit 11 leads to an annular piston 15 which is arranged coaxially with respect to the pump shaft 4 and which assumes the function of a hydraulic actuator along the displacement path of the regulating slide valve 7.

A return spring 17 acts upon the annular piston 15 in a direction opposite to the pressure of the hydraulic circuit 11, i.e. away from the impeller 5. The annular piston 15 communicates with the regulating slide valve 7 and moves this toward the impeller 5 as the pressure of the hydraulic circuit 11 increases.

One exemplary function for adjusting the volume flow of the coolant pump will now be described.

When no drive current is supplied, the electromagnetic proportional valve 13 is open such that the coolant drawn by the axial piston pump 9 flows substantially without pressure via the branch 11*a* of the hydraulic circuit 11 and through the proportional valve 13 back into the pumped coolant flow. Therefore, no pressure builds up in the branch 11*b* of the hydraulic circuit 11, and the annular piston 15 remains in the unactuated initial position under the action of the return spring 17. In this case, the regulating slide valve 7, which communicates with the annular piston 15, is kept in the "open position", as is shown in FIGS. 1 and 2.

In the "open position" of the regulating slide valve, a maximum pumped volume flow is generated, regardless of the pump speed, without shielding of a flow-effective area of the impeller 5 by the regulating slide valve 7. This state at the same represents a fail-safe mode to the effect that maximum volume flow and maximum heat output of the internal combustion engine are automatically ensured in the event of a power supply failure or a control defect, i.e. a deenergized electromagnetic proportional valve 13.

When the electromagnetic proportional valve 13 is temporarily closed as a result of time-controlled supply of a drive current, the coolant ejected by the axial piston pump 9 cannot flow back into the volume flow via the branch 11*a* of the hydraulic circuit 11. The pressure applied by the axial piston pump 9 in the hydraulic circuit 11 spreads from the backpressure at the dosed proportional valve 13 into the branch 11*b* via the branch 11*a* and acts upon the annular piston 15. The annular piston 15 moves the regulating slide valve 7 towards the impeller against the force of the return spring 17. In this process, the cylindrical portion 7*a* of the regulating slide valve 7 is increasingly caused to axially overlap the impeller 5, as a consequence of which an effective flow area of the impeller 5 is radially covered by the cylindrical portion 7*a* of the regulating slide valve 7.

In the "dosed position" of the regulating slide valve 7, the cylindrical portion 7*a* completely covers the impeller 5 such that a minimal pumped volume flow is generated regardless of the pump speed in that a flow-effective area of the impeller 5 is completely shielded by the regulating slide valve 7.

Controlling the on and off periods of the electromagnetic proportional valve 13 gives rise to the controlled build-up of backpressure in the branch 11*a,* and thus to the controlled build-up of pressure in the branch 11*b* of the hydraulic circuit 11, which acts upon the annular piston 15 and against the return spring 17. The annular piston 15 moves the regulating slide valve 7 between the "open position" and "dosed position" as described above, to adjust the pumped volume flow of the coolant pump.

The central engine control unit ZMS calculates the volume flow of the coolant to be pumped, which corresponds to the required heat output of the internal combustion engine, by taking account of various operating parameters such as the speed and working load of the internal combustion engine, the fuel supplied, the temperature, the vehicle speed, and the like.

As has been described above, the volume flow of coolant pumped by the coolant pump depends, on the one hand, on the flow effectiveness of the impeller 5, which decreases around the impeller 5 with an increasing degree of coverage by the cylindrical portion 7*a* of the regulating slide valve 7 as the position of the regulating slide valve 7 (and of the annular piston 15) is, to an increasing extent, axially shifted towards the "dosed position".

On the other hand, the pumped volume flow of the coolant pump depends on the pump speed. The pump speed is invariably dictated by the speed of the internal combustion engine as a result of the belt drive and includes the fluctuations characteristic of vehicle operation.

Figure 4:
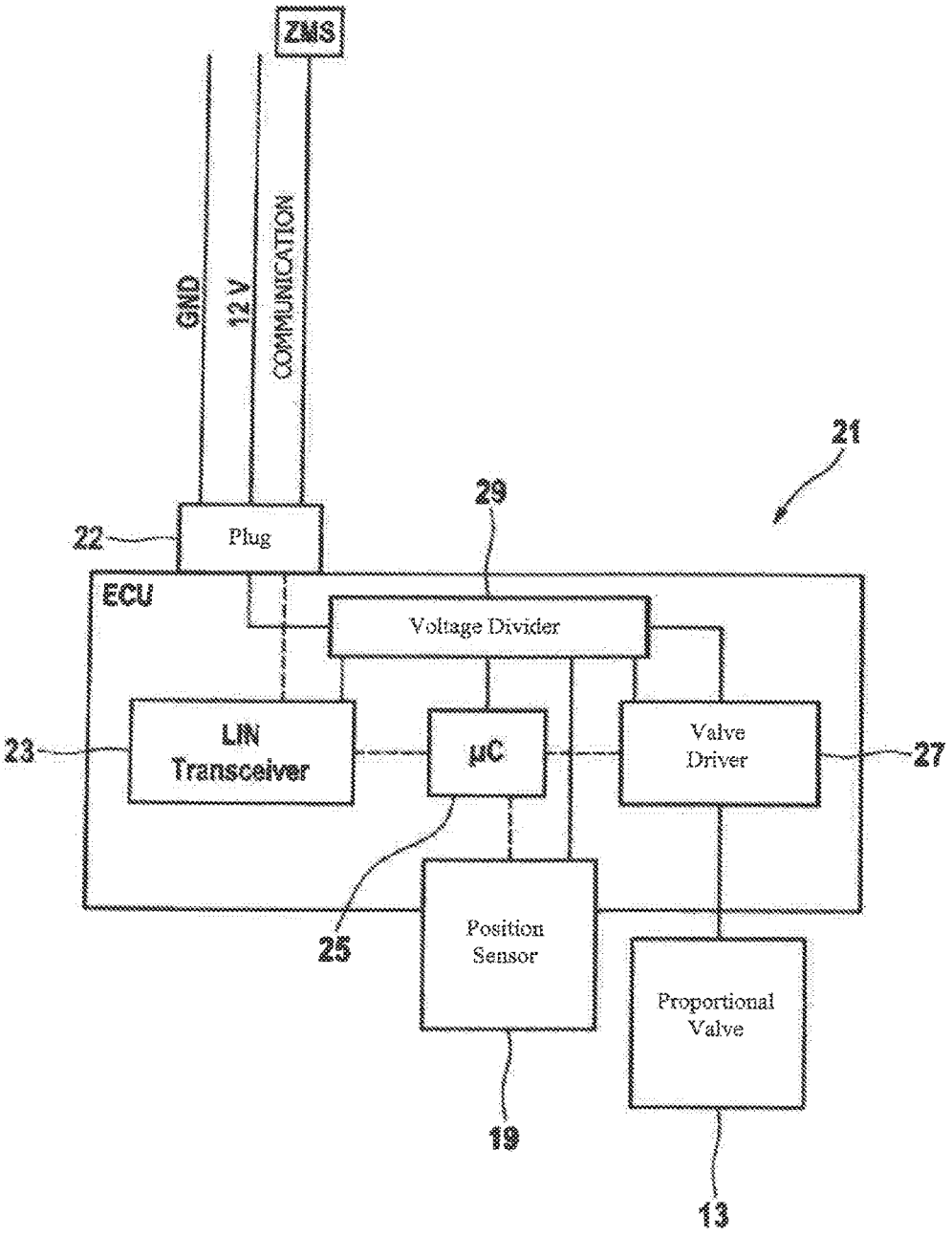
FIG. 4 is a schematic block diagram of the pump control according to the present invention.

An exemplary configuration of the pump control 21 will now be described with reference to FIG. 4.

In one example embodiment, the pump control 21 comprises a transceiver 23, such as a LIN transceiver, a microcomputer 25, a valve driver 27 and a power supply distributor 29. The power supply distributor divides the voltage from a vehicle power source (not shown), such as 12V, into suitable voltages of the electronic components 23, 25, 27 of the pump control 21 and supplies these with the required electric power. The LIN transceiver 23 enables data communication via a data bus, e.g. in the LIN protocol, between the pump control 21 and the central engine control unit ZMS. As is shown in FIG. 2, a plug 22 can be provided for connection with an on-board data bus linked to the central engine control unit ZMS. The microcomputer 25 carries out a control program with a control procedure which is stored in a memory (not shown) of the microcomputer 25, and calculates a pulse width modulation as the drive signal of the valve driver 27. The valve driver 27 amplifies the drive signal from the microcomputer 25 by activating and deactivating, in accordance with the pulse width modulation, the supply of power from the power supply distributor 29 for actuating the electromagnetic proportional valve 13.

Figure 3A:
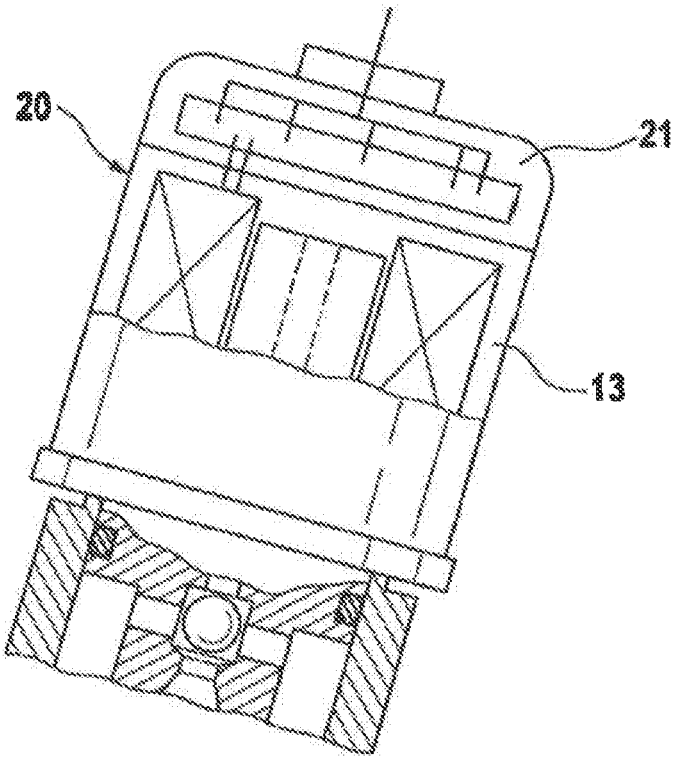
FIG. 3A is a sectional view of an electromechanical component of FIG. 1 in which a pump control is integrated into a proportional valve.
Figure 3B:
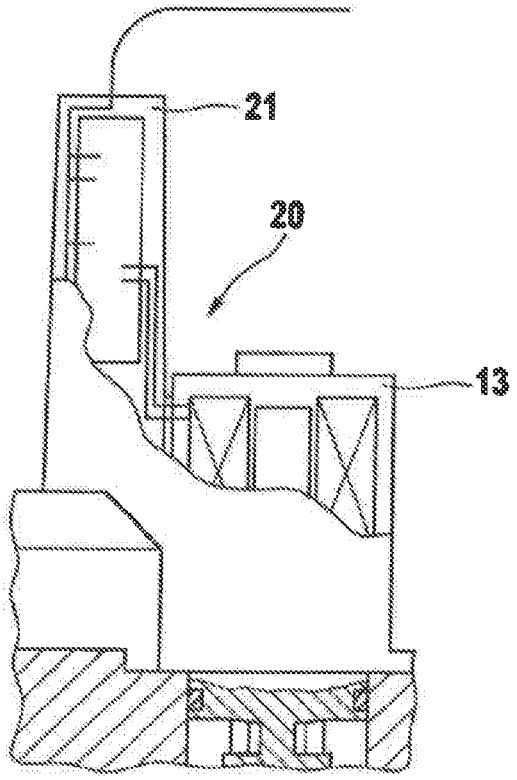
FIG. 3B is a sectional view of an electromechanical component of FIG. 2 in which a pump control and a proportional valve are integrated with one another.

In one example embodiment shown in FIGS. 3A and 3B, the pump control 21 is formed together with a solenoid valve as a single electromechanical component 20. For example, a control circuit of the pump control 21 and an electromagnetic control unit of the proportional valve 13 can be cast into one enclosed component.

If the housing of the proportional valve has a cylindrical shape, as is shown in FIG. 3A, the circuit board of the pump control 21 may, for example, be circular in shape so as to be capable of being integrated in a space-saving manner in the region of the bottom of the housing. Insofar as the dimensions of the single component 20 of the pump control 21 and proportional valve 13 do not exceed the dimensions of a conventionally used valve, it is moreover possible to upgrade a known ECF pump without modifying the pump construction.

Otherwise, the pump control 21 can be integrated on an outer region of the housing of the proportional valve 13, as is shown in FIG. 3B.

Furthermore, various shapes and arrangements for integration of the pump control 21 with the proportional valve 13 arise as a result of the design of the type of valve used. It is also possible to use an electric motor actuated proportional valve 13, which forms a single electromechanical component with the pump control 21, instead of the electromagnetic proportional valve 13. In this case, the drive signal for a servomotor does not need to contain a pulse width modulation.

The shown configuration can be preferably implemented using a Hall effect sensor as the position sensor 19. However, this embodiment is not limited to a Hall effect sensor, as will be described later in a further embodiment.

Figure 2:
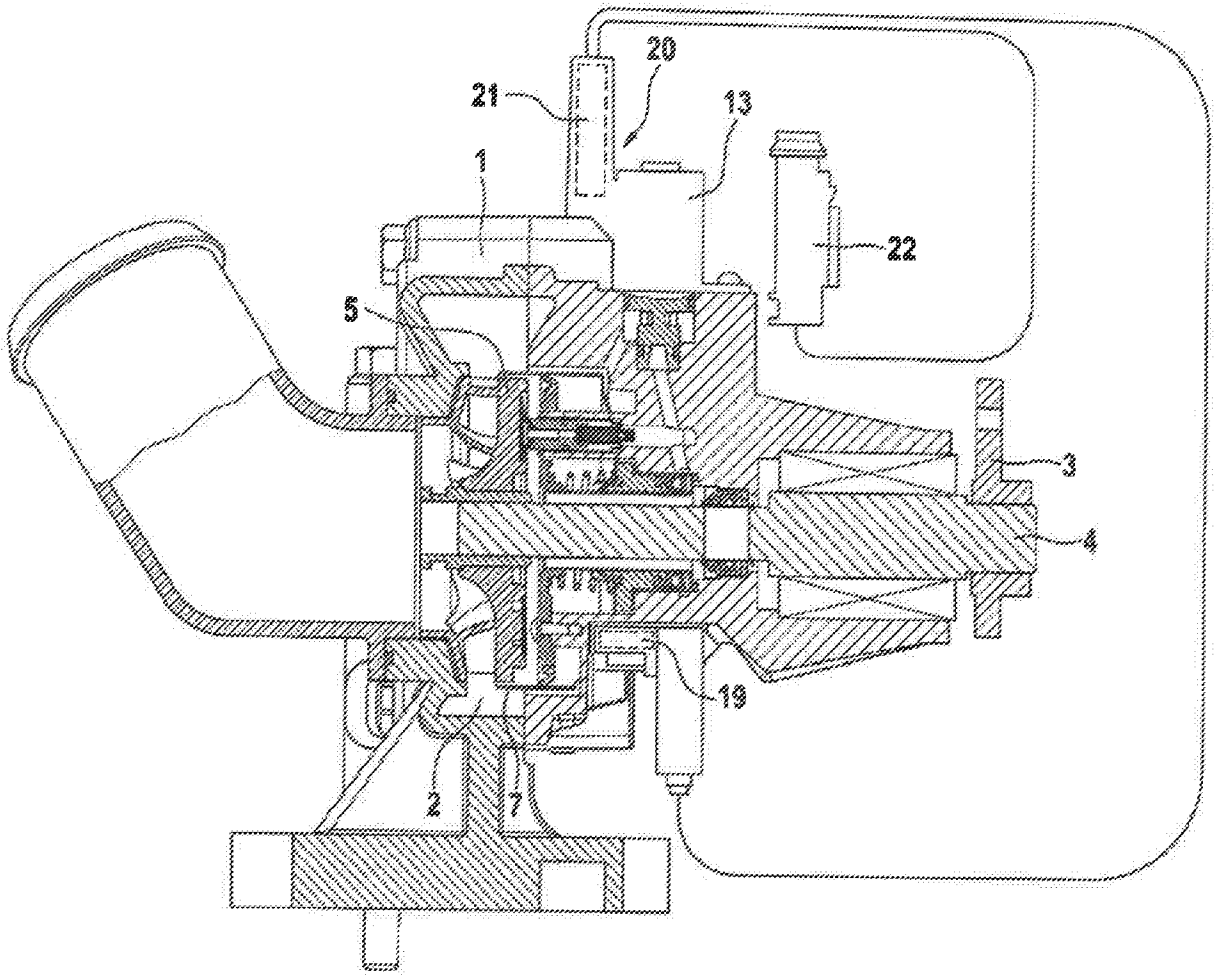
FIG. 2 is a sectional view of a configuration of a coolant pump with a pump control according to the present invention, which is equipped with a plug for connection with a data bus.

In one embodiment of the coolant pump shown in FIG. 1, a position sensor 19 is used to detect the position of the regulating slide valve 7 along a displacement path. A contactless and robust construction is provided by a Hall effect sensor and a magnetic transmitter element which is connected to the annular piston 15. The position sensor 19 outputs to the pump control 21 as an actual value signal the detected position of the annular piston 15, and accordingly of the regulating slide valve 7, along the displacement path.

In one example embodiment, the desired value signal which is received by the pump control 21 from the central engine control unit ZIPS contains a predetermined position of the regulating slide valve 7. To this end, the central engine control unit ZMS calculates the volume flow of the coolant to be pumped by the coolant pump on the basis of the required heat output of the internal combustion engine. The predetermined position of the regulating slide valve is then calculated depending on the volume flow and the current pump speed, which has a fixed speed ratio relative to the internal combustion engine, and is transmitted to the pump control 21.

In a further preferred embodiment, the desired value signal which is received by the pump control 21 from the central engine control unit ZMS contains just one desired value for the required volume flow of the coolant as well as further operating parameters such as, in particular, the current speed of the internal combustion engine or the corresponding pump speed. In this embodiment, the desired value for the resulting position of the regulating slide valve 7 is calculated in the pump control 21.

The control procedure executed in the microcomputer 25 corresponds, for example, to the control function of a PID member with which a deviation is calculated between the predefined desired value and the actual value. Based on this deviation, a pulse width modulation for controlling the electromagnetic proportional valve 13 is calculated on the basis of a system-specific function of the hydraulic circuit 11, i.e. a response behaviour between the on and off periods of the electromagnetic proportional valve 13 and a resulting position change of the annular piston 15 as a hydraulic actuator.

In order to retain the position of the regulating slide valve 7, the pressure in the hydraulic circuit 11 is controlled by means of the on and off periods for opening and closing the proportional valve 13 in such a way that an equilibrium corresponding to the predefined desired value of the central engine control unit ZMS is achieved and maintained between the hydraulic pressure and the pressure of the return spring 17 at the position of the annular piston 15 and the regulating slide valve 7. The actual position of the regulating slide valve 7 is detected by the position sensor 19 and transmitted to the pump control 21 or entered into the microcomputer 25 as feedback for controlling the proportional valve 13.

According to a further example embodiment, the pump control 21 carries out function monitoring to autonomously identify and report to the central engine control unit leaks in the cooling system.

If air has become trapped in the coolant circuit as a result of leaks, it will also enter the hydraulic circuit 11 of the coolant pump and reduce the pressure in the hydraulic actuator. The characteristic curve of the return spring 17 which counteracts the annular piston 15 remains unchanged. The disequilibrium between the reduced hydraulic pressure and the unchanged characteristic curve of the return spring 17 must in this case be compensated by increasing the ratio of the on period to the off period of the electromagnetic proportional valve 13 so as to produce the hydraulic pressure for the desired position of the annular piston 15.

The simple control loop between the position sensor 19 of the regulating slide valve 7 and the electromagnetic proportional valve 13 in the hydraulic circuit 11 allows the pump control 21 according to the invention to detect deviations in the response behaviour of the hydraulic circuit with the required sensitivity, i.e. particularly without being influenced by further operating parameters such as permanent speed and temperature fluctuations. The pump control 21 compares a deviation from the ratio between the on and off periods of the electromagnetic proportional valve 13 and the resulting position change of the annular piston 15 and regulating slide valve 7 with a threshold value stored in the memory. The threshold value is stored in a memory portion of the pump control 21, as are other specific parameters of the coolant pump.

If an error is detected, the pump control 21 outputs an error message to the central engine control unit which can, in turn, initiate limited emergency operation or switch off the internal combustion engine.

In an alternative example embodiment, the coolant pump comprises a pressure sensor (not shown), which is preferably arranged between the annular piston 15 and the regulating slide valve 7, instead of the position sensor 19.

In this alternative embodiment, the pump control 21 carries out control in that the regulating slide valve 7 is moved into a new position so as to adjust the volume flow until the actual value signal of the pressure detected by the pressure sensor corresponds to the pressure of the predetermined volume flow, which is predefined by the desired value signal from the central engine control unit ZMS.

In this embodiment, function monitoring of the cooling system can be performed based simply on the existing pressure sensor rather than on the response behaviour of the hydraulic actuator. As has been described with regard to the previous embodiment, a threshold value is stored in a memory portion of the pump control. This threshold value corresponds to a minimal operating pressure which is particularly undershot when air becomes trapped in the cooling system. After comparing the desired value with the value detected by the pressure sensor, the pump control 21 evaluates whether there is a leak in the cooling system.

If an error is detected, the pump control 21 outputs an error message to the central engine control unit ZMS which can, in turn, initiate limited emergency operation or switch off the internal combustion engine.

It is furthermore possible to provide a CAN interface instead of a LIN interface between the pump control 21 and the central engine control unit ZMS.

The invention claimed is:

1. A coolant pump configured to pump a coolant for an internal combustion engine in a vehicle comprising the internal combustion engine and a central engine control unit, said coolant pump comprising:

a pump shaft which is rotatably mounted in a pump housing and driven by the internal combustion engine via a belt drive, an impeller which is arranged on the pump shaft and accommodated in a pump chamber of the pump housing, pumping the coolant, an axial piston pump which is actuated via a wobble plate on a rear side of the impeller and which branches-off a fraction of the pumped coolant, a hydraulic circuit which extends from the axial piston pump via a proportional valve back to the pumped coolant and which includes a branch between the axial piston pump and the proportional valve as a hydraulic actuator, a regulating slide valve which adjusts the volume flow of the coolant pumped by the coolant pump and which is slidable depending on a pressure in the hydraulic circuit, a sensor which detects a parameter indicative of the volume flow of the pumped coolant and which outputs an actual value signal of the parameter, and a dedicated pump control which controls the proportional valve in the hydraulic circuit on the basis of the actual value signal from the sensor and a desired value signal from the central engine control unit, and wherein the pump control and the proportional valve are formed as a mutual electromechanical component.

2. The coolant pump according to claim 1, wherein the sensor is a position sensor which detects a position of the regulating slide valve, and the desired value signal indicates (i) a predetermined position of the regulating slide valve or a predetermined volume flow and a speed of the internal combustion engine or coolant pump.

3. The coolant pump according to claim 1, wherein the pump control limits a path of the regulating slide valve in an upper speed range of the pump.

4. The coolant pump according to claim 1, wherein the pump control compares a relationship between the control duration of the proportional valve and a resulting position change of the regulating slide valve with a threshold value.

5. The coolant pump according to claim 1, wherein the sensor is a pressure sensor which detects the pressure of the pumped volume flow of the coolant, and the desired value signal indicates i) a predetermined volume flow or ii) a pressure which is indicative of the volume flow of the pumped coolant.

6. The coolant pump according to claim 5, wherein the pump control compares the pressure detected by the sensor with a threshold value.

7. The coolant pump according to claim 1, wherein the pump control comprises a transceiver for receiving data from the central engine control unit and/or for sending data thereto, a microcomputer for performing a control procedure, a valve driver for driving the proportional valve, and a power supply distributor for supplying each component with electric power.

8. The coolant pump according to claim 1, wherein the single electromechanical component is configured such that the pump control is integrated into a housing of the proportional valve.

9. The coolant pump according to claim 1, wherein the mutual electromechanical component is configured such that the pump control has a housing of its own which is integral with a housing of the proportional valve.

10. The coolant pump according to claim 1, wherein the coolant to be pumped flows through a coolant inlet axially directed towards the impeller and is pumped by the impeller so as to leave the pump chamber via a radial coolant outlet.

11. The coolant pump according to claim 1, wherein the coolant to be pumped flows through a coolant inlet axially directed towards the impeller and is pumped by the impeller so as to leave the pump chamber via an axial or semi-axial coolant outlet on the opposite side of the impeller.

12. The coolant pump according to claim 1, wherein the coolant pump is a mechanically driven coolant pump, and wherein the central engine control unit is configured to calculate the desired value of the parameter, depending on operating parameters of the internal combustion engine.

13. The coolant pump according to claim 12, wherein the parameter which is indicative of the volume flow of the pumped coolant is a position of the regulating slide valve.

14. The coolant pump according to claim 12, wherein the parameter which is indicative of the volume flow of the pumped coolant is a pressure in a pump chamber of the coolant pump which corresponds to the volume flow of the pumped coolant.

15. The coolant pump according to claim 1, wherein the coolant pump is a mechanically driven coolant pump, wherein the central engine control unit is configured to transmit operating parameters of the internal combustion engine to the pump control, and wherein the pump control is configured to calculate the desired value of the parameter, depending on the operating parameters of the internal combustion engine, and to tune the position of the regulating slide valve, depending on the desired value and the actual value by controlling the hydraulic actuator.

16. The coolant pump according to claim 15, wherein the pump control limits the pumped volume flow of the coolant pump, depending on the desired value and the actual value by controlling the hydraulic actuator.

17. An electromechanical component configured for use in a mechanically driven coolant pump of a vehicle with an internal combustion engine and a central engine control unit, comprising:

a pump control, and a proportional valve configured as a hydraulic actuator of a hydraulic circuit, wherein a position of a regulating slide valve in a pump chamber, which limits the pumped volume flow of the coolant pump, is shifted by the hydraulic circuit.

* * * * *